US005738619A

United States Patent [19]

Nattrass

[11] Patent Number: 5,738,619

[45] Date of Patent: Apr. 14, 1998

[54] METHOD OF MANUFACTURING BULK BAGS

[75] Inventor: Peter J. Nattrass, Barrington Hills, Ill.

[73] Assignee: Bulk Lift International Incorporated, Carpentersville, Ill.

[21] Appl. No.: 514,860

[22] Filed: Aug. 14, 1995

Related U.S. Application Data

[60] Division of Ser. No. 208,579, Mar. 11, 1994, abandoned, which is a continuation-in-part of Ser. No. 115,113, Sep. 2, 1993, Pat. No. 5,415,614.

[51] Int. Cl.[6] ..... B31B 21/00

[52] U.S. Cl. ..... 493/226; 112/475.08; 493/210; 493/217

[58] Field of Search ..... 493/100, 102, 493/210, 217, 226, 223, 224, 936; 112/475.08

[56] References Cited

U.S. PATENT DOCUMENTS

| | | | |
|---|---|---|---|
| 686,847 | 11/1901 | Green | 493/217 |
| 4,194,652 | 3/1980 | Williamson | 112/475.08 |
| 4,300,608 | 11/1981 | Cuthbertson | 493/226 |
| 4,307,764 | 12/1981 | Nattress | 150/1 |
| 4,493,109 | 1/1985 | Nattress | 493/226 |
| 4,703,519 | 10/1987 | Krenzel | 29/463 |

FOREIGN PATENT DOCUMENTS

| | | | |
|---|---|---|---|
| 0047539 | 3/1982 | European Pat. Off. | 493/226 |
| 2904210 | 4/1980 | Germany | 483/217 |

*Primary Examiner*—Jack W. Lavinder

*Attorney, Agent, or Firm*—Dorn, McEachran, Jambor & Keating

[57] ABSTRACT

A method of manufacturing a bulk bag, which bulk bag can be used for shipment of powder without loss, yet which does not require a full inner liner for the bulk bag and has a surface receptive to imprinted indicia on the bulk bag body. A bag body of height Y is cut from a fabric tube of circumference X having an imprint-receptive outer surface and is partially lined with a tubular partial film liner of like dimensions; two bands of reinforced resin tape are adhesively bonded to the top and bottom rims of the body liner. There are top and bottom panels, each cut from a flat web of coated, powder-impervious fabric, and each having a circumferential length X; these panels are stitched into the bag body with stitching that extends through the resin tape to simultaneously mount the panels and the partial liner in the bag body, completing a bulk bag suitable for powder shipments but with an imprint-receptive external surface.

10 Claims, 4 Drawing Sheets

METHOD OF MANUFACTURING BULK BAGS

RELATION TO PRIOR APPLICATIONS

This application is a division of the application Ser. No. 08/208,579 filed on Mar. 11, 1994, now abandoned, which was a continuation-in-part of the prior application of Peter J. Nattrass, Ser. No. 08/115,113 filed Sep. 2, 1993, for "Manufacture of Bulk Bags", now U.S. Pat. No. 5,415,614 issued May 16, 1995.

BACKGROUND OF THE INVENTION

The use of large fabric bags to ship semi-bulk quantities of powder or granular material, bags which can be lifted only by forklift trucks, cranes, or similar material handling equipment, is prevalent. Technically, such bags are FIBCs, for "Flexible Intermediate Bulk Containers"; they are also known as "bulk bags" and are referred to as such in this specification. The size of a bulk bag may vary substantially, depending upon the density of the material transported, the rated weight capacity of the bulk bag, and other factors. In general, a bulk bag usually has a height substantially exceeding twenty inches (51 cm) and a periphery of more than ninety inches (228 cm). A bulk bag is often rectangular (usually square) in cross section; it may be round or of other cross-sectional configuration.

Early bulk bags, as shown in U.S. Pat. No. 4,010,784 of Frank and Peter Nattrass, had four lifting loops attached to the top corners of the bag. Each top corner was folded into a substantially S-shaped configuration and a leg of each lifting loop was positioned between two of the resulting three layers and stitched in place.

Another bulk bag construction, disclosed in U.S. Pat. No. 4,307,764 to Peter Nattrass, utilizes three rectangular fabric pieces; one piece forms two sides and the bottom of the bulk bag, whereas the other two pieces form opposed sides. Each of these three fabric pieces has two side edges folded over; legs of the lifting loops extend into the tops of the folds at each corner of the bag and are sewn in place.

Another known bulk bag construction, described in Futerman U.S. Pat. No. 4,362,199, has spread leg lifting loops at each top corner of the bag, with the loop legs aligned with reinforced bands in the bulk bag side walls. In the preferred construction the top of each side wall is folded over so that two layers of side wall fabric are joined to each lifting loop leg. A variation of this construction is shown in Derby et al. U.S. Pat. No. 4,457,456, with lifting loops formed from a continuous length of webbing having a series of V-shaped projections. Again, the top of the bag is usually folded over to provide a double layer. A somewhat similar construction, shown in Peter Nattrass U.S. Pat. No. 4,646,357, employs individual lift loops having their legs spread out across each corner of the bag; the top of the bag is folded over to form a double horizontal layer.

Another bulk bag construction, shown in Peter Nattrass U.S. Pat. No. 4,822,179, has lifting loops formed of multiple layers of the same fabric as the body of the bulk bag.

In Hughes U.S. Pat. No. 5,108,196, the top of a bulk bag is folded over to afford a double layer; a triple layer is described as preferred. The leg portions of the lifting loops are aligned with reinforced bands in the side walls. The lifting loops are secured to the top of the bag by chain stitching that extends around the entire top periphery of the bag, with all loop legs anchored to the folded portion of the bag top. A related construction, but with lifting loops individually attached to reinforcing strips, is described in the British Patent Publication No. 2 132 171 of S. Hartman. In F. Nattrass U.S. Pat. No. 4,610,028, the lifting loops are formed as integral extensions of reinforced portions of the bulk bag side walls.

In commercial versions of some of these bulk bags, migration of powder through the bag body has been prevented by positioning a resin film liner in the bulk bag, so that the completed bag actually has double walls all around. To keep the liner in the bulk bag when it is emptied, the liner may be glued in place. Alternatively, the liner may be stitched into the bulk bag, but this presents a possibility that some powders may pass out through the openings created by the stitching.

Another expedient employed to stop powder loss or "sifting" has been the use of a coated fabric in the side walls of the bulk bag. The most effective coatings constitute a poor base for the printing required by users of the bulk bags. This presents little or no problem when the bulk bag is made up of pieces cut from a flat coated fabric because the coating can be located on the inside of the bag where the user doesn't want or need printing anyway. But there is an appreciable problem if the side walls of the bulk bag are formed of a coated tubular fabric. Coating or otherwise laminating a powder-impervious layer on the tubular fabric is expensive and is difficult to control without major possibility of excessive waste. If the anti-sifting coating is located on the outside of the bag, there is no satisfactory print-receptive surface and the coating may peel off in use of the bag. Coating the inside surface of a tubular fabric is both difficult and expensive; it may be virtually impossible. Coating the outside followed by turning the tubular fabric inside out is expensive and hard to control and hence usually unsatisfactory. The inside and outside diameters are similar but different, and the tubular fabric has a strong tendency to wrinkle, to an extent such that manufacturing procedures are made difficult and excessively expensive.

SUMMARY OF THE INVENTION

It is a principal object of the invention, therefore, to provide a new and improved method of manufacture for a bulk bag that permits use of a tubular fabric in a bulk bag that is effectively impervious to powder "sifting" through the bulk bag, that affords an uncoated, print-receptive surface on the outer side walls of the bulk bag, yet does not require a full inner film liner in the bulk bag.

A specific object of the invention is to provide a new and improved method of manufacture for a powder-safe bulk bag that minimizes the quantity of tubular side wall fabric employed in the bulk bag, that allows effective use of a partial film liner in the bulk bag, and that greatly reduces the amount of labor employed to make the bulk bag, all without appreciable loss of strength in the finished product.

Accordingly, the invention relates to the method of manufacturing a bulk bag suitable for shipping powder without requiring a full film liner for the bulk bag, the bulk bag having a height Y and a circumferential length X. The method comprises the following steps:

A. severing a bag body of height Y from a seamless, uncoated flexible fabric tube of circumference X having an imprint-receptive outer surface, the fabric of the tube being of woven resin and being at least partially pervious to powder;

B. cutting a bottom wall panel of polygon shape from a web of coated, woven fabric, substantially impervious to powder, the bottom wall panel having a circumferential length at least equal to X; a top wall panel of similar size and shape may also be formed;

C. severing a body liner of height Y from a tube of resin film of circumference X, the resin film being substantially impervious to powder;

D. adhesively mounting two powder-impervious tapes on the body liner, each tape encompassing one end of the body liner;

E. inserting the body liner into the bag body;

F. stitching the bottom wall panel into the bag body with stitching that extends through the tape at the bottom of the bag liner; and G. stitching the top of the bag liner to the bag body with stitching that extends through the tape at the top of the bag liner; the same stitching may serve to anchor a top wall panel in place.

DESCRIPTION OF THE PREFERRED EMBODIMENTS

Figure 1:
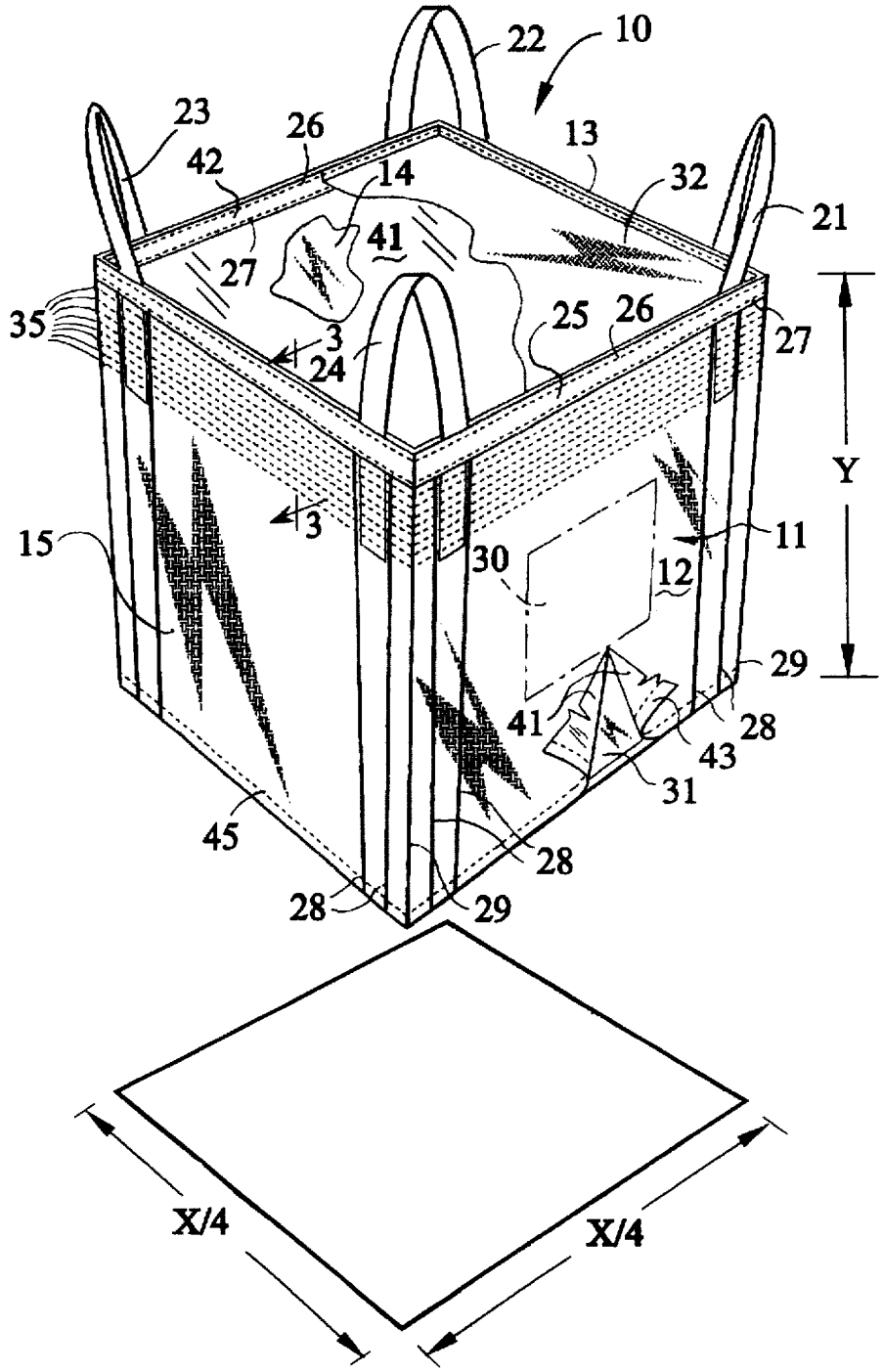
FIG. 1 is a perspective front elevation view of a bulk bag constructed in accordance with one embodiment of the invention, with some portions of the bulk bag cut away.

FIG. 1 illustrates a bulk bag 10 constructed in accordance with a method that constitutes an embodiment of the invention. Bulk bag 10 comprises a flexible fabric side wall or bag body 11 that is marked to indicate four side wall panels 12,13,14 and 15. Bag body 11 is cut from a continuous fabric tube. Bag body 11 has an overall height Y which, in this instance, corresponds to the overall height of bulk bag 10. There is no substantial horizontal fold at the top of bulk bag 10; narrow hems to prevent fraying (not shown) are permissible and frequently desirable at both the top and bottom edges of bag body 11. Bag body 11 is shown as rectangular (square) in cross-section with a circumferential length X. The bag body can be rectangular or of other external shape, depending on the shapes of top and bottom wall panels referred to hereinafter. For most bulk bags, the height Y is at least about twenty inches (51 cm); more frequently, that height is in a range of thirty-six to seventy-two inches (91 to 180 cm). The circumferential length X for bag 10 should be at least about ninety inches (228 cm). Perhaps the most common total circumferential length X for a bulk bag is approximately one hundred forty inches (355 cm).

Bulk bag 10, FIG. 1, has four lift loop straps 21,22,23 and 24. Lift loop strap 21 has two legs, with one leg attached to the top of each of the side walls 12 and 13 of the bag body 11, across the corner between those two side walls. Loop 22 is anchored to the tops of body panels 13 and 14, across the corner therebetween. Lift loop strap 23 is mounted on the tops of the panels 14 and 15 of bag body 11. The fourth lift loop strap 24 has one leg sewn to the top of the panel 15 of bag body 11 and the other leg sewn to the top of panel 12. Lift loop strap 24, which is typical of all of the lift loops, is a continuous strap, which may be formed of webbing or like strong material or may be made of plural layers of side wall fabric as in U.S. Pat. No. 4,822,179. Typical widths for straps 21–24 are about two to four inches (7.5 to 10 cm). A safety band 25, usually a relatively narrow webbing, extends around the periphery of the top end of the side wall bag body 11. Safety band 25 is sewn to the top of the bag structure by appropriate stitching 26,27; one line of band stitching is often adequate, but two or even more lines of stitching may be utilized, as described hereinafter.

In bulk bag 10, the bottom and the top of bag body 11 are closed off by bottom and top wall panels 31 and 32, respectively. Wall panels 31 and 32 may incorporate appropriate outlet and inlet structures (not shown). As shown in FIG. 1, the lift loop strap legs positioned externally of the side wall panels of bulk bag body 11; they could be on the inside. In the preferred construction shown in FIG. 1, each leg of each lift loop is aligned with a fabric band, delineated by lines 28 that extend vertically of bag body 11. The fabric bands between lines 28 may be the same as the rest of bag body 11 or the band may be reinforced. If reinforced bands are utilized, the reinforcement bands are preferably woven integrally into and extend parallel to the axis of the tubular fabric from which bag body 11 is cut. That is, the reinforcement bands, when used, are preferably of the kind described in detail in the pending U.S. patent application of Peter J. Nattrass, Ser. No. 08/115,113, referred to above now U.S. Pat. No. 5,415,614. The corner junctions between panels, which in bag 10 are arbitrary, may be marked by further lines 29 woven into the tubular fabric from which bag body 11 is cut.

In bulk bag 10 all of the lift loop straps 21–24 (FIG. 1) are anchored to the side wall structure of the bulk bag body 11 by a plurality of parallel lines of anchor stitching 35, preferably chain stitching or lock stitching, beginning a short distance below the top edge of the bulk bag. The spacing between stitching lines 35 is preferably about one inch (2.5 cm) or less. Each of these lines of stitching 35 extends completely around the top of the bag body 11, across all of the leg portions of the lift loop straps 21–24 in a horizontal direction, parallel to the top edge of the side walls. In FIG. 1 eight equally-spaced lines of anchor stitching 35 are shown. Typically, this would be the number of lines of stitching required to anchor the lift loops to a bulk bag having a rated capacity of three metric tons. As few as three rows of chain stitching 35 may be sufficient for a bulk bag having a rated capacity of only one metric ton. On the other hand, for a bulk bag with a rated capacity of two metric tons, six rows of stitching of high-strength thread may be appropriate for anchor stitching 35.

The preferred fabric for side wall panels 11–14 is a plainwoven fabric, with narrow polypropylene tape, 0.25 inch (0.063 cm) or less in width, used as the yarn for the weave in both the warp and the weft. The preferred thread for the stitching 35 that anchors lift loop straps 21–24 to the top of the body 11 of bulk bag 10 is a polyester or polypropylene filament thread having a minimum tensile strength of sixty pounds. On the other hand, even stronger thread may be employed for the anchor stitching, up to at least one hundred twenty-five pounds tensile strength. The thread for stitching 35 preferably should have an overall size of between 3,000 and 6,000 denier or even more.

Bulk bag 10 is constructed on a basis contrary to many conventional concepts. To begin with, there is no individual anchoring of the lift loop straps 21–24 to the top of the bulk bag. That is, the individual multiple stitching operations usually employed in anchoring lift loop straps to the top of a bulk bag are not employed. At the same time, moreover, there is no substantial horizontal fold in the top of the side wall structure comprising bag body 11, panels 12–15. As previously noted, a small hem to preclude fraying is permissible. In bulk bag 10, though, there is no excess length of side panel fabric, as would be required for a horizontal fold having height comparable to the lift loop leg lengths. Elimination of a substantial fold could be expected to reduce the overall strength of bulk bag 10, according to conventional wisdom; in actual fact, bulk bag 10 is not weakened, and, if anything, is stronger than prior constructions.

As thus far described, bulk bag 10 conforms to the constructions described in the prior U.S. patent application of Peter J. Nattrass, Ser. No. 08/115,113, now U.S. Pat. No. 5,415,614, of which this application is a continuation-in-part. Structural variations described therein can, for the most part, be applied to bulk bag 10. If bag body 11 and the bottom and top wall panels 31 and 32 were all formed of coated fabric, bulk bag 10 would be suitable for use in shipping a material containing fine powder particles, but the bag would be unduly expensive and would present appreciable difficulties in manufacture, as noted above. Moreover, there would be no external surface on bulk bag 10 suitable for imprinting with the user's identifying indicia 30, as required by many users.

The need for an imprint-receptive surface is met by using an uncoated fabric for bag body 11. If that expedient were adopted however, and particularly if panels 31 and 32 were also made of an uncoated fabric, fine powder particles could pass through the fabric, particularly at the location of sewing such as stitching lines 27, 35, and 45. That problem has usually been met, in the past, by using a complete film liner within the bulk bag; this arrangement, however, again leads to added cost and also may require some arrangement to anchor the liner in the interior of bulk bag 10 so that the liner will not be discharged therefrom along with the bulk bag contents. In bulk bag 10 both of these expedients are avoided but the finished bag is suitable for shipment of powder without loss and a large imprint-receptive surface is retained on the bag body 11.

Bulk bag 10 includes a tubular partial film liner 41, substantially impervious to powder. Liner 41 is actually a partial liner for bag 10; it has no top or bottom. The partial liner 41 is most economically formed by cutting a segmental length from a resin film tube having a circumferential length X, the length of the severed film tube segment being approximately equal to Y so that the partial liner 41 corresponds dimensionally to bag body 11.

Figure 3:
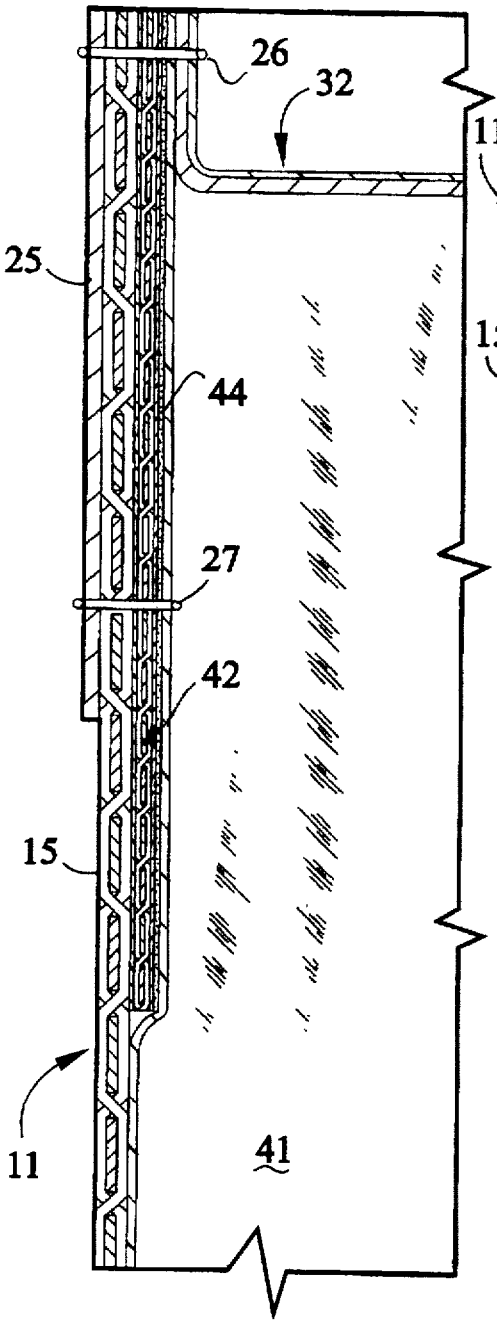
FIG. 3 is a detail sectional view, on a further enlarged scale, taken approximately as indicated by lines 3—3 in FIGS. 1 and 2, with the thickness of some elements further enlarged.
Figure 4:
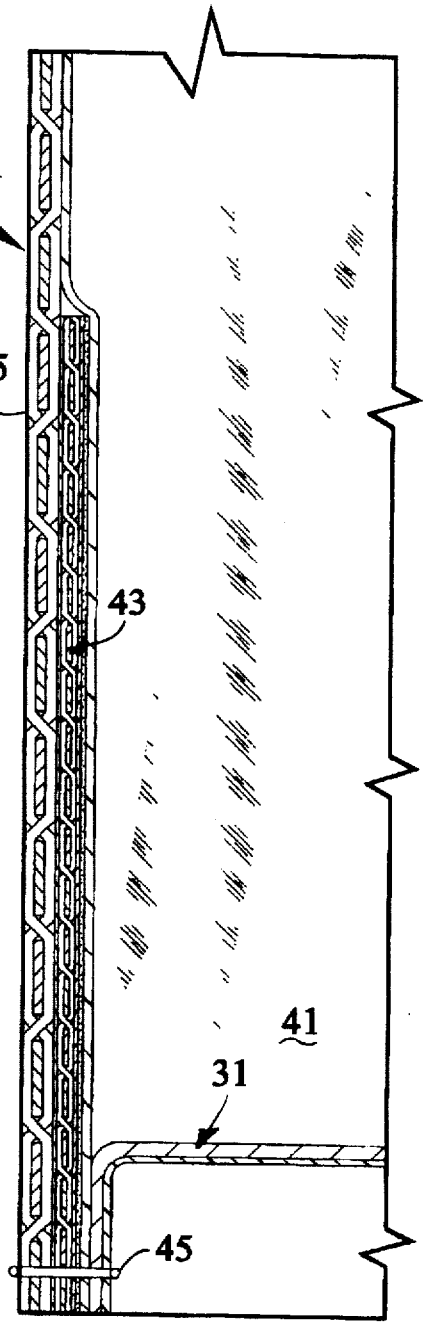
FIG. 4 is a detail sectional view, like FIG. 3 but taken at the bottom of the bulk bag.

There are two tape bands 42 and 43 adhesively secured to the top and bottom, respectively, of the partial film liner 41. In the illustrated construction each tape band has an adhesive surface 44 that bonds the tape to the tubular film liner 41; see FIGS. 2 and 3 for the preferred positioning of tape 42 relative to the top of liner 41, the top of panel segment 15 of bag body 11, safety band 25, top panel wall 32, and safety band stitching 26, 27. As shown, tape 42 is adhesively bonded to the top outer surface of partial liner 41 by its adhesive coating 44; all of the bag components from the outside of the bag in, constituting safety band 25, bag body 11 (panel 15), tape 42, film partial liner 41, and top wall panel 32, are affixed to each other by the uppermost safety band stitching 26. A similar construction is used at the bottom of the bulk bag. As shown in FIG. 4; again from the outside of the bulk bag in, the bulk bag body 11 (panel 15), tape 43, partial film liner 41, and bottom wall panel 31 are all stitched together by one line 45 of stitching.

The two tape bands 42 and 43 are similar to conventional duct tape; generally speaking however, conventional duct tape is not strong enough and lacks other desirable characteristics (e.g. aging) for use in bulk bag 10. A tape that has been found satisfactory for use in bulk bags, for the purposes of tapes 42 and 43 in the present invention, is No. 865 bi-directional polyester reinforced tape from Related Products, Inc. of Elk Grove Village, Ill., U.S.A. That tape is a polyester film reinforced with a woven fiberglass cloth. The tape is coated with a synthetic rubber pressure-sensitive adhesive and has the following average properties:

| | |
|---|---|
| Tensile Strength (lbs./in.) | 90 |
| Thickness | 0.0069 inch |
| 90° Peel Adhesion (oz./in.) | 85 |
| Percent Elongation | 6 |
| Application Temperature Range (F.) | 120°–40° |
| Adhesive Performance Range (F.) | 150°–35° |

Other strong tape may be employed as desired. The reason for use of a strong woven tape, preferably reinforced, is to preclude the stitching (e.g., stitching 26, 27, or 45) from splitting the tape and, more importantly, the liner; even if it is cut, the adhesive will hold the tape in place.

Figure 5:
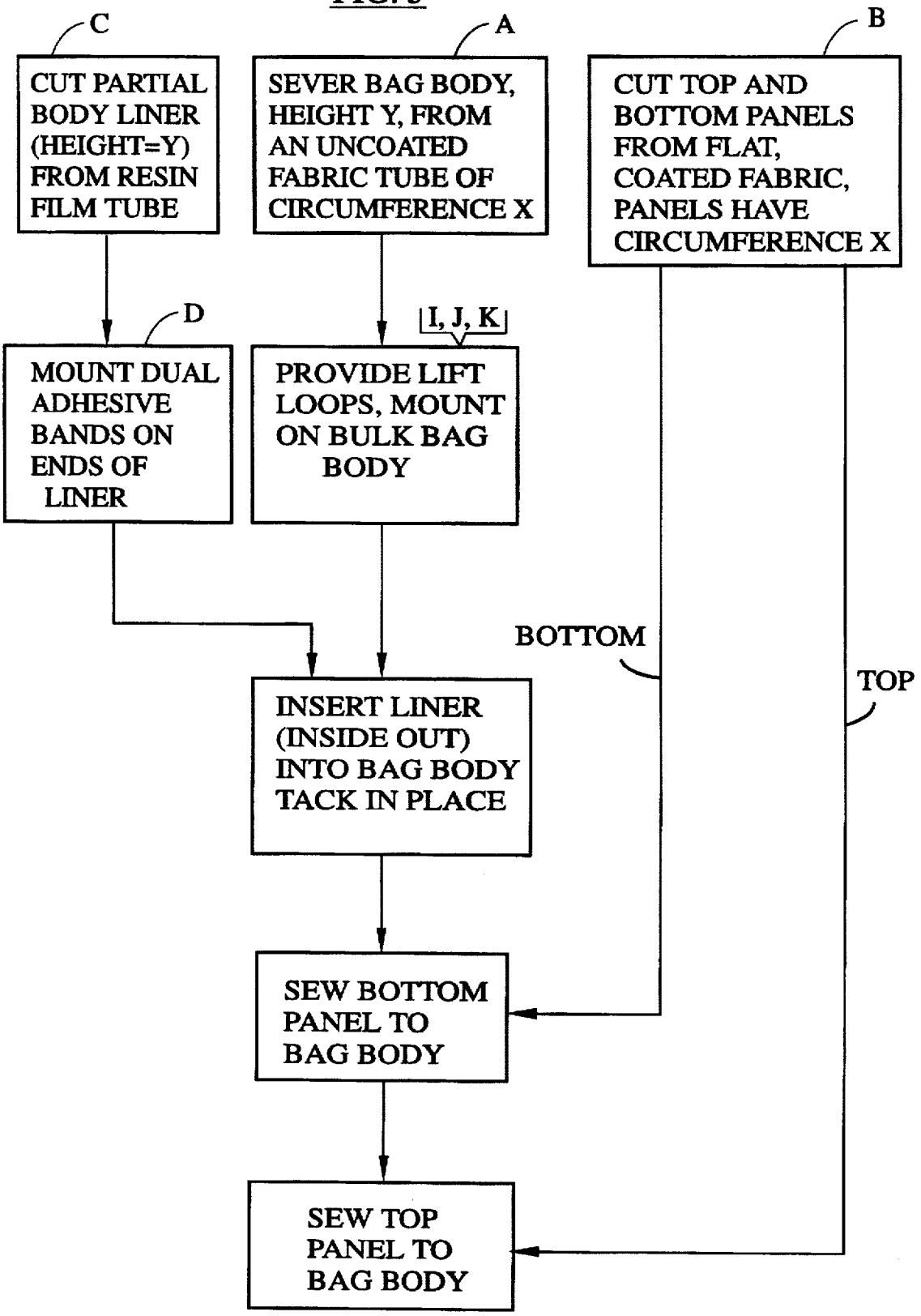
FIG. 5 is a flow chart illustrating the method steps of the invention.

In the manufacture of bulk bag 10, according to the preferred method of the present invention, the starting materials include a continuous plain woven resin fabric tube of circumference X, which is uncoated, and at least one flat web of coated plain woven fabric. Two flat webs may be used; the web for the bottom panels of the bag should be as strong as the fabric tube but a lighter web and be employed for top wall panels, which do not need to carry the weight of the bulk bag contents. A further starting material comprises a continuous tubular resin film having a circumference corresponding to the fabric tube circumference X. A supply of a strong tape, impervious to powder, is needed, preferably a resin tape with a fiberglass cloth or like reinforcement. The tape should be smooth on both surfaces and one surface should be coated with a pressure-sensitive adhesive; a tape width of two inches (5.0 cm) is typical, but other widths are permissible. A supply of strong thread, usually polyester or polypropylene thread of at least 3,000 denier thickness, is needed. The steps in manufacture of the bulk bag, which may be varied in sequence to meet the needs of the manufacturer, are illustrated in FIG. 5. Those steps are:

A. A bag body of height Y is severed from the fabric tube of circumference X, so that the bag body has an imprint-receptive outer surface, the fabric of the tube being at least partially pervious to powder. A small hem may be made at the top and bottom of the bag body to preclude fraying.

B. Polygonal top and bottom wall panels are cut from the flat web of coated, woven fabric, which should be substantially impervious to powder. Each top and bottom wall panel has a circumferential length at least equal to X; they are preferably slightly larger than X. The top and bottom wall panels are preferably cut to the same configuration; rectangular, square, or other shapes may be utilized for these top and bottom wall panels. Round top and bottom panels are not particularly desirable; they are too difficult to cut.

C. A body liner of height Y is cut from the tube of resin film of circumference X, the resin film being substantially impervious to powder.

D. Two bands of the powder-impervious tape are mounted on the body liner, each tape encompassing one end of the body liner; the pressure-sensitive coating on the one side of the tape is used for this purpose. Each tape band should extend completely around the body liner. Accordingly, the length of each tape band should exceed X.

Figure 2:
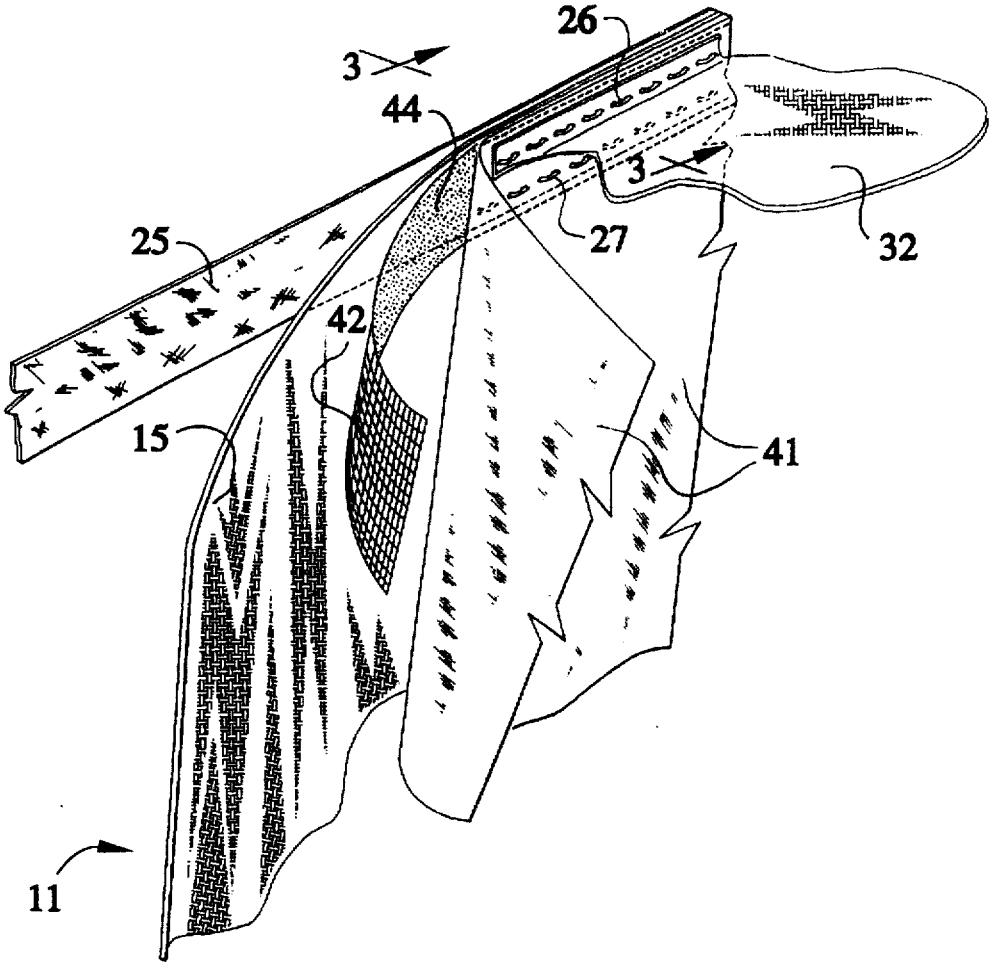
FIG. 2 is a detail perspective view, on an enlarged scale, illustrating how components of the bulk bag of FIG. 1 are joined to each other at the top of the bag at an intermediate stage of manufacture.

E. The body liner is inserted into the bag body and preferably is tacked in place, as by the stitching 27 (FIGS. 1–3). The body liner is preferably turned inside out before insertion into the bag body for stitching so as not to damage it from the sewing machine.

F. The bottom wall panel is stitched into the bag body with stitching 45, FIG. 4, using the thread supply, that extends through the tape 43 at the bottom of the bag partial liner.

G. The top of liner partial 41 is stitched into the bag body with stitching 26, FIG. 3, using the same thread supply, stitching 26 extends through the resin tape 42 at the top of the bag liner, and also mounts top wall panel 32 (if present) in place. If a safety band 25 is used at the top of the bag body, stitching 26 is also used to mount the safety band on the bag.

These are the basic steps for the method of the present invention, but they do not provide lift loops for the bulk bag. For lifting loops, the following additional steps are necessary; they are preferably performed before step E.

I. A plurality of lift loop straps are provided, each lift loop strap comprising a continuous fabric strap having first and second legs. Webbing or fabric straps may be used for the lift loops, with widths preferably in a range of two to four inches (5 to 10 cm).

J. The legs of each lift loop strap are aligned at one of a series of equally spaced locations around the top of the bulk bag body, with both legs of each lift loop strap extending a short distance downwardly from the top edge of the bulk bag body. If the bag body includes vertical reinforcement bands, each loop leg is preferably aligned with the top part of one reinforcement band. Any reinforcement bands should preferably be woven into the tube from which the bag body is cut.

K. The legs of each of the lift loop straps are stitched to the top end of the bulk bag body with a plurality of at least three lines of anchor stitching of high-strength thread, the anchor stitching lines each extending transversely across the lift loop strap legs in a horizontal direction, parallel to the top edge of the bulk bag body, thereby anchoring all of the lift loop straps to the top of the bulk bag body. The lines of anchor stitching are preferably equally spaced; the spacing should be no greater than about one inch (2.5 cm). The anchor stitching is preferably polyester or polypropylene thread of at least 3,000 denier. The loop stitching does not extend through the liner when the loops are mounted before step E.

FIGS. 3 and 4 illustrate, in detail, the manner in which the top and bottom panels 32 and 31 are sewn into bulk bag body 11. Thus, as shown in FIG. 3, stitching 26 and 27 serves to mount safety band 25 on the top of bulk bag body 11 (panel 15 appears in FIG. 3). Stitching 26 passes through the periphery of top panel 32, through the top of the partial bag liner 41, and through the top of bag body 15. Thus, the one line of stitching 26 is utilized to mount the top wall panel 32, the safety band 25, and the partial liner 41 in the bag. A similar construction technique can be used at the bottom of the bulk bag, as shown by FIG. 4. Stitching 45 is employed to mount bottom wall panel 31 and the bottom of partial liner 41, with tape 43, in the bottom of bag body 11. There is no safety band at the bottom of bag 10. In FIGS. 3 and 4 top and bottom wall panels 32 and 31 are shown as double layers because a coated fabric is used in each.

The bulk bags 10 are strong and durable, and can readily be constructed to meet all of the industry requirements and tests imposed on FIBCs. That is equally true with respect to bulk bags that vary from the basic features of bulk bag 10. As previously noted, the bulk bags can be used to ship powder without loss; they are "powder-tight".

In manufacture of any such bulk bag it is desirable to limit the number of sewing operations as much as possible. The best manufacturing procedure is to apply the anchor stitching with a sewing machine assembly incorporating four simultaneously operable sewing heads. If only three or six lines of anchor stitching are required to meet the weight capacity requirements of the bulk bag, the thread and needle should be omitted from one sewing head. For four or eight anchor stitching lines, all sewing heads are equipped with needles and supplied with thread. In either case a single sewing operation around the top of the bulk bag body anchors all lifting loop straps in place, a major reduction in assembly labor as compared with conventional techniques. The lines of stitching 26, 27 and 45 effectively unite partial liner 41 with bag body 11, and can also mount safety band 25 on the bulk bag. As compared to conventional bags, the overall labor in manufacture is readily reduced by a factor of four or more; the reduction may equal or exceed a factor of eight. For bulk bags requiring six or eight lines of anchor stitching 35, two sewing passes around the bag body top may be needed; there is still a substantial reduction in labor costs.

As shown in the drawings, bulk bag 10 has bottom and top panels 31 and 32, which could include conventional outlet and inlet structures (not shown) for filling and emptying the bag. Other top and bottom panel constructions could also be used with the same basic bulk bag body. The top panel 32, in particular, can vary considerably. A film cylinder of substantial height could be utilized, a duffle top could be employed, or other variations could be utilized with the basic bag body. Moreover, and as noted above, if a fabric top panel is employed it can be appreciably lighter in weight than the bag body or the bottom panel (e.g., a three ounce fabric top for a six ounce fabric bag body).

I claim:

1. The method of manufacturing a bulk bag suitable for shipping powder without requiring a full film liner for the bulk bag, the bulk bag having a height Y and a circumferential length X, the method comprising the following steps:

A. severing a bag body of height Y from a seamless, uncoated flexible fabric tube of circumference X having an imprint-receptive outer surface, the fabric of the tube being of woven resin and being at least partially pervious to powder;

B. cutting a bottom wall panel of polygon shape from a web of coated, woven fabric, substantially impervious to powder, the bottom wall panel having a circumferential length at least equal to X;

C. severing a body liner of height Y from a tube of resin film of circumference X, the resin film being substantially impervious to powder;

D. adhesively mounting two powder-impervious resin tapes on the body liner, each tape encompassing one end of the body liner;

E. inserting the body liner into the bag body;

F. stitching the bottom wall panel into the bag body with stitching that extends through the tape at the bottom of the bag liner; and G. stitching the top of the bag liner to the bag body with stitching that extends through the tape at the top of the bag liner.

2. The method of manuacturing a bulk bag according to claim 1 and including the following additional steps:

H. cutting a top wall panel of polygon shape from a web of coated woven fabric, substantially impervious to powder, the top wall panel having a circumferential length at least equal to X; and G1. stitching the top wall panel into the bag body in step G.

3. The method of manufacturing a bulk bag according to claim 2 in which the top and bottom wall panels are each cut from a flat fabric web of woven resin fabric and the top and bottom wall panels are cut to the same size and configuration.

4. The method of manufacturing a bulk bag according to claim 2, in which the top and bottom wall panels are each cut to a rectangular configuration.

5. The method of manufacturing a bulk bag according to claim 1 in which the resin tapes are each a polyester film tape reinforced with a woven fiberglass cloth.

6. The method of manufacturing a bulk bag according to claim 5, in which each tape is coated on one side with a pressure-sensitive adhesive used to mount the tape on one end of the body liner.

7. The method of manufacturing a bulk bag according to claim 1, and comprising the following additional steps, performed before step E:

I. providing a plurality of lift loop straps, each lift loop strap comprising a continuous fabric strap having first and second legs;

J. aligning the legs of each lift loop strap of step I at one of a series of spaced locations around the top of the bulk bag body, with both legs of each lift loop strap extending a short distance downwardly from the top edge of the bulk bag body; and K. stitching the legs of each of the lift loop straps to the top end of the bulk bag body with a plurality of at least three lines of anchor stitching of high-strength thread, the anchor stitching lines each extending transversely across the lift loop strap legs of the lift loop straps in a horizontal direction, parallel to the top edge of the bulk bag body, thereby anchoring all of the lift loop straps to the top of the bulk bag body.

8. The method of manufacturing a bulk bag according to claim 7, comprising the following additional steps:

L. prior to step A, incorporating a plurality of reinforcement bands in the body tubing fabric tube for the bag body, with each reinforcement band extending longitudinally of the tube parallel to its axis; and I1. in step I, aligning each leg of each lift loop strap leg with one reinforcement band in the fabric bag body tube so that the lift loop strap leg is anchored to and constitutes a continuation of the reinforcement band.

9. The method of manufacturing a bulk bag according to claim 7, in which the lines of anchor stitching are maintained equally spaced from each other and the spacing between lines of anchor stitching is no greater than about one inch (2.5 cm).

10. The method of manufacturing a bulk bag according to claim 7, in which the thread for the anchor stitching is a polyester or polypropylene resin thread that has a size of at least three thousand denier.

* * * * *